US010161707B2

(12) United States Patent
Scott

(10) Patent No.: US 10,161,707 B2
(45) Date of Patent: Dec. 25, 2018

(54) SHOOTING-STABILITY PLATFORM FOR FIREARMS

(71) Applicant: II GUYS-N-GUNS LLC, Midlothian, TX (US)

(72) Inventor: Timothy Neal Scott, Waxahachie, TX (US)

(73) Assignee: II GUYS-N-GUNS LLC, Midlothian, TX (US)

( * ) Notice: Subject to any disclaimer, the term of this patent is extended or adjusted under 35 U.S.C. 154(b) by 0 days.

(21) Appl. No.: 15/611,942

(22) Filed: Jun. 2, 2017

(65) Prior Publication Data

US 2018/0058795 A1 Mar. 1, 2018

Related U.S. Application Data

(60) Provisional application No. 62/380,251, filed on Aug. 26, 2016.

(51) Int. Cl.
*F41A 23/06* (2006.01)
*F41A 23/34* (2006.01)

(52) U.S. Cl.
CPC ..... *F41A 23/34* (2013.01); *F41A 23/06* (2013.01)

(58) Field of Classification Search
CPC ..... F41A 23/04; F41A 23/06; F41A 23/34
USPC ..... 42/94; 89/37.04
See application file for complete search history.

(56) References Cited

U.S. PATENT DOCUMENTS

| | | | | |
|---|---|---|---|---|
| 3,608,852 | A | 9/1971 | Horn | |
| 4,345,398 | A | 8/1982 | Pickett | |
| 4,434,703 | A | 3/1984 | Fog et al. | |
| 4,833,951 | A | 5/1989 | Karcher et al. | |
| 4,967,497 | A * | 11/1990 | Yakscoe | F41A 23/14 42/94 |
| 5,081,782 | A | 1/1992 | Wright | |
| 5,294,092 | A | 3/1994 | Wade et al. | |
| 5,372,517 | A | 12/1994 | Levesque | |
| 5,421,115 | A * | 6/1995 | McKay | F41A 23/12 248/163.1 |
| 5,666,757 | A | 9/1997 | Helmstadter | |
| 5,964,435 | A | 10/1999 | Peltier | |
| 5,979,099 | A | 11/1999 | Kervin | |
| 6,123,306 | A | 9/2000 | Jackson | |
| 6,293,041 | B2 | 9/2001 | Weaver | |
| 6,920,713 | B1 | 7/2005 | Love | |
| 7,313,884 | B2 | 1/2008 | Eddins | |
| 7,823,318 | B2 | 11/2010 | Hall | |
| 7,980,599 | B2 | 7/2011 | Schindel | |
| 8,251,330 | B2 | 8/2012 | Stabler | |
| 8,327,570 | B2 | 12/2012 | Potterfield et al. | |
| 8,448,369 | B2 | 5/2013 | Hinds, Jr. | |
| 8,549,786 | B1 | 10/2013 | Griffith | |
| 8,905,391 | B2 | 12/2014 | Weissenborn | |
| 9,163,893 | B1 | 10/2015 | Gutierrez | |
| 9,303,940 | B2 | 4/2016 | Bonelli et al. | |
| 9,316,457 | B2 | 4/2016 | Hagedorn et al. | |
| 9,441,902 | B2 | 9/2016 | Noel | |

(Continued)

*Primary Examiner* — Stephen Johnson
(74) *Attorney, Agent, or Firm* — D. Tiller Law PLLC; Don Tiller

(57) ABSTRACT

A shooting-stability platform with three rotational degrees of freedom is disclosed. The platform improves shooting accuracy and safety by lessening recoil effects. And because of the rotational degrees of freedom, the operator still has substantial freedom to position the firearm as desired.

19 Claims, 11 Drawing Sheets

(56) References Cited

U.S. PATENT DOCUMENTS

| | | | | |
|---|---|---|---|---|
| 9,573,268 | B2 | 2/2017 | Azhocar | |
| 9,587,899 | B2 | 3/2017 | Frey | |
| 9,587,900 | B2 | 3/2017 | Kereth | |
| 2007/0074439 | A2 | 4/2007 | Cauley et al. | |
| 2009/0277068 | A1 | 11/2009 | Lamar | |
| 2010/0122482 | A1 | 5/2010 | Simms et al. | |
| 2010/0162609 | A1* | 7/2010 | Rogers | F41C 23/02 42/85 |
| 2012/0180643 | A1* | 7/2012 | Woods | F41A 27/18 89/37.04 |
| 2016/0054089 | A1 | 2/2016 | Sherman | |
| 2016/0209172 | A1 | 7/2016 | Trotabas | |

* cited by examiner

A – A′

B – B′

SHOOTING-STABILITY PLATFORM FOR FIREARMS

CROSS-REFERENCE TO RELATED APPLICATIONS

This application claims the benefit of U.S. Provisional Application No. 62/380,251, filed on Aug. 26, 2016.

BACKGROUND

This invention pertains generally to technology for stabilizing firearms while shooting. More specifically, it pertains to a platform configured to hold a firearm and to limit the motion of the firearm while the firearm is discharged. This platform enables the firearm operator to discharge the firearm more accurately and more safely than otherwise. For example, the platform may be mounted to an all-terrain vehicle (ATV) and the operator of the ATV may single-handedly discharge a firearm held by the platform while still seated in the ATV. Similarly, the platform, whether free-standing or mounted to a surface, can enable an amputee firearm operator to discharge the firearm more accurately and more safely than otherwise.

A firearm operator must overcome forces that lead to an unstable firearm when discharging a firearm. The firearm recoils when discharged. Typically, the operator braces against the recoil, attempting to keep the firearm stable. Nevertheless, the firearm and operator move in response to the recoil force. The firearm moves back toward the operator (opposite the direction of the projectile) and the operator compensates by pushing the firearm forward (toward the direction of the projectile). As a result, the firearm moves forward and backward, reducing accuracy and safety when two or more discharges are required, especially as the time between discharges decreases. The recoil force may also cause the muzzle of the firearm to rise in response to the discharge. To compensate for this muzzle rise, the operator attempts to rotate the firearm or his body so that the muzzle moves down. As a result, the muzzle moves up and down, reducing accuracy and safety when two or more discharges are required, especially as the time between discharges decreases.

The safety and accuracy issues related to multiple discharges of a firearm are exacerbated if the operator is not able to support the firearm fully and properly. For example, the operator's physical condition or environment may prevent him from fully supporting the firearm. This makes it more difficult for the operator to stabilize the firearm for and during discharge.

There are various prior-art technologies aimed at helping a firearm operator stabilize a firearm. These technologies range from handles attached to the firearm to allow the operator more easily to hold the firearm (see, e.g., U.S. Pat. No. 9,573,268) to devices that capture the firearm and make it more difficult for the recoil to move the firearm (see, e.g., U.S. Pat. No. 9,163,893 and U.S. Pat. No. 9,316,457). The prior-art approaches generally fail in one of two respects: (1) the stabilizing device restricts movement of the firearm to the point that the operator's ability to position the firearm is unduly hampered and (2) the stabilizing device does not adequately restrict the unwanted movement of the firearm due to the recoil.

Accordingly, there is need for a platform that will attach to a firearm, stabilize the firearm against the recoil effects, and still allow the firearm operator substantial freedom to position the firearm.

SUMMARY

The present invention is directed to systems that satisfy the need for an apparatus to stabilize a firearm during discharge without unduly restricting the positioning of the firearm.

In one aspect of the invention, a firearm stabilizing apparatus includes two connected risers, two connected articulating joints, and an accessory-rail adapter configured to mount to the accessory rail on a firearm (e.g., a Picatinny rail). The risers may be, for example, telescopically connected or threadedly connected such that the length of the combined risers may be adjusted. The articulating joints work in concert to enable three rotational degrees of freedom for a firearm when the firearm is mounted to the apparatus via the accessory rail adapter. Specifically, the mounted firearm is at least somewhat free: to rotate azimuthally about the longitudinal axis of the first or second riser, to pivot up or down (polar rotation) relative to the longitudinal axis of the first or second riser, and to slant left or right (cant angle) relative to the longitudinal axis of the first or second riser. Because of the three degrees of freedom, the firearm operator has the ability to comfortably and properly position the firearm while the firearm is restrained by the stabilizing apparatus.

In another aspect of the invention, a firearm stabilizing apparatus includes an adjustable-length riser, a means to secure the firearm to the apparatus, a means for enabling an azimuth-angle-rotation degree of freedom for the firearm when secured, a means for enabling a polar-angle-rotation degree of freedom for the firearm when secured, and a means for enabling a cant-angle-rotation degree of freedom for the firearm when secured. Because of the three degrees of freedom and the adjustable length, the firearm operator has the ability to comfortably and properly position the firearm while the firearm is restrained by the stabilizing apparatus.

BRIEF DESCRIPTION OF THE DRAWINGS

These and other features, aspects, and advantages of the present invention will be become better understood with reference to the following description, appended claims, and accompanying drawings where:

DETAILED DESCRIPTION

Figure 1:
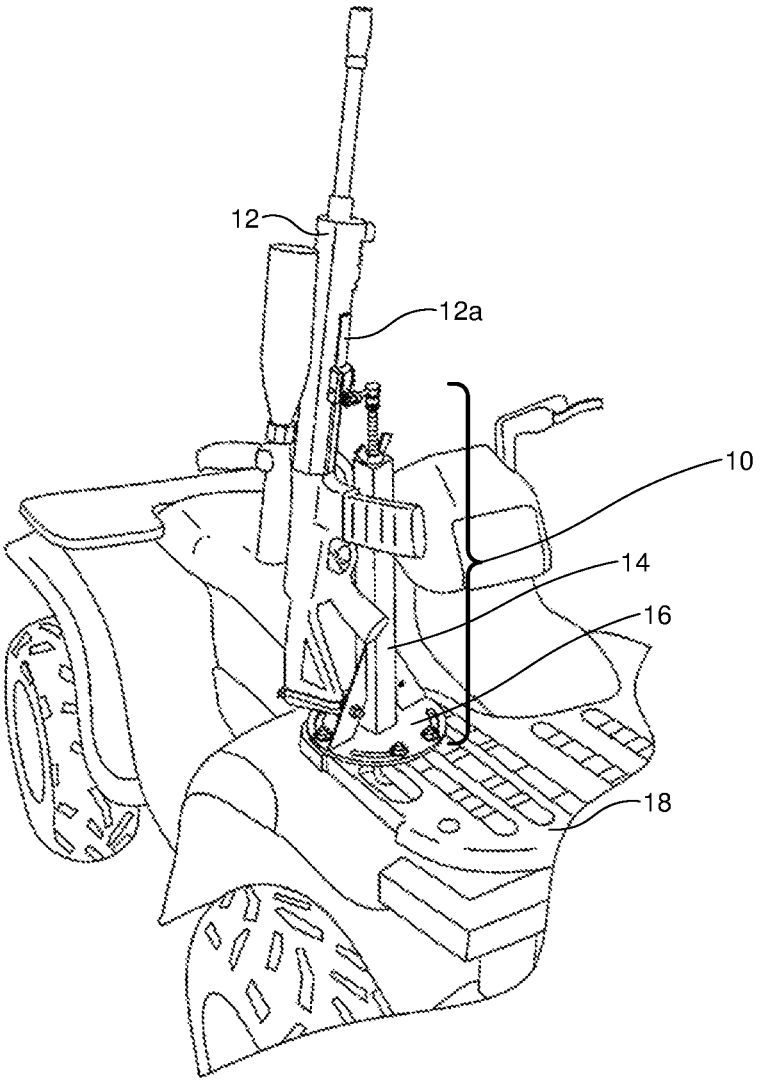
FIG. 1 is a perspective view illustrating an exemplary shooting-stability platform mounted to an ATV and securing a rifle according to the invention.

In the summary above, and in the description below, reference is made to particular features of the invention in the context of exemplary embodiments of the invention. The features are described in the context of the exemplary embodiments to facilitate understanding. But the invention is not limited to the exemplary embodiments. And the features are not limited to the embodiments by which they are described. The invention provides a number of inventive features which can be combined in many ways, and the invention can be embodied in a wide variety of contexts. Unless expressly set forth as an essential feature of the invention, a feature of a particular embodiment should not be read into the claims unless expressly recited in a claim.

Except as explicitly defined otherwise, the words and phrases used herein, including terms used in the claims, carry the same meaning they carry to one of ordinary skill in the art as ordinarily used in the art.

Because one of ordinary skill in the art may best understand the structure of the invention by the function of various structural features of the invention, certain structural features may be explained or claimed with reference to the function of a feature. Unless used in the context of describing or claiming a particular inventive function (e.g., a process), reference to the function of a structural feature refers to the capability of the structural feature, not to an instance of use of the invention.

Except for claims that include language introducing a function with "means for" or "step for," the claims are not recited in so-called means-plus-function or step-plus-function format governed by 35 U.S.C. § 112(f). Claims that include the "means for [function]" language but also recite the structure for performing the function are not means-plus-function claims governed by § 112(f). Claims that include the "step for [function]" language but also recite an act for performing the function are not step-plus-function claims governed by § 112(f).

Except as otherwise stated herein or as is otherwise clear from context, the inventive methods comprising or consisting of more than one step may be carried out without concern for the order of the steps.

The terms "comprising," "comprises," "including," "includes," "having," "haves," and their grammatical equivalents are used herein to mean that other components or steps are optionally present. For example, an article comprising A, B, and C includes an article having only A, B, and C as well as articles having A, B, C, and other components. And a method comprising the steps A, B, and C includes methods having only the steps A, B, and C as well as methods having the steps A, B, C, and other steps.

Terms of degree, such as "substantially," "about," and "roughly" are used herein to denote features that satisfy their technological purpose equivalently to a feature that is "exact." For example, a component A is "substantially" perpendicular to a second component B if A and B are at an angle such as to equivalently satisfy the technological purpose of A being perpendicular to B.

Except as otherwise stated herein, or as is otherwise clear from context, the term "or" is used herein in its inclusive sense. For example, "A or B" means "A or B, or both A and B."

As used herein, the term "accessory rail" refers to the class of brackets integral to or attached to a firearm that provide a mounting platform for accessories such as flashlights, sights, and slings. Examples of accessory rails include the Picatinny rail (also known as MIL-STD-1913 rail), the Weaver rail, the Glock rail, and sling mounts.

As used herein, the term "accessory-rail adapter" refers to the class of mechanical assemblies that are configured to attach to a firearm's accessory rail.

As used herein, the term "articulating joint" refers to the class of joints that allow at least one rotational degree of freedom but no translational degree of freedom. Examples of articulating joints include spherical bearings (e.g., rod-end bearings (e.g., Heim joints) and ball joints) and hinge joints.

As used herein, the term "riser" refers to an elongated mechanical member, such as a rod or a tube.

As used herein, the terms "male coupling" and "female coupling" refer to the class of quick-connect joints in which a male coupling includes a plug that fits within a socket or box in a female coupling. A quick-connect joint may be a rigid joint or an articulating joint. Examples of coupling quick-connect joints include ball-lock couplings, roller-lock couplings, pin-lock couplings, flat-face couplings, bayonet couplings, ring-lock couplings, and cam-lock couplings.

As used herein, the term "vertical axis" of a firearm refers to the axis perpendicular to the bore axis and running through the front sight of the firearm.

FIG. 1 depicts an exemplary shooting-stability platform 10 comprising a tubing riser 14 and a base plate 16. The shooting-stability platform 10 is mounted to an ATV by bolting the base plate 16 to a rack 18 on the ATV. A rifle 12 is mounted to the shooting-stability platform 10 via an accessory rail 12*a* on the rifle.

Figure 2:
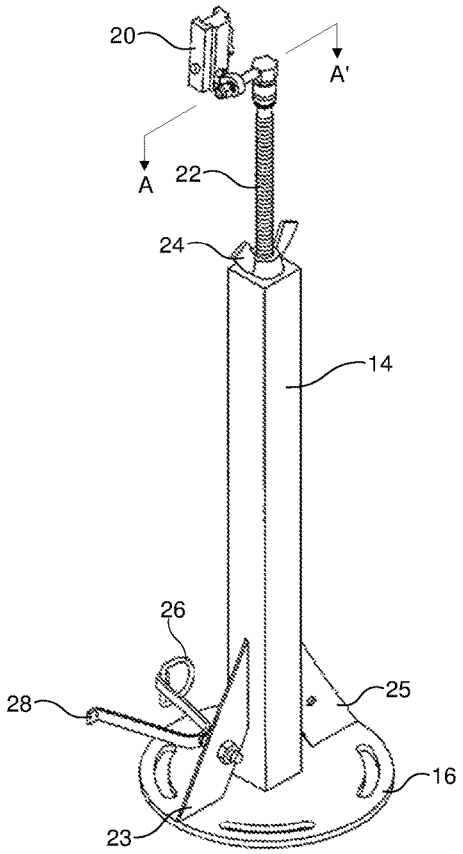
FIG. 2 is a perspective view illustrating an exemplary shooting-stability platform according to the invention.

FIG. 2 depicts the exemplary shooting-stability platform 10. The shooting-stability platform 10 comprises a tubing riser 14, a base plate 16, and a threaded riser 22 connected to an accessory-rail adaptor 20 through an articulating joint. The platform 10 includes a rifle-butt holder 28 with a securing latch 26. Side supports 23, 25 support the riser 14 where it is attached to the base plate 16. The threaded riser 22 is secured in the tubing riser 14 through threads in the inside of the tubing riser 14 and a wing nut 24.

Figure 3:
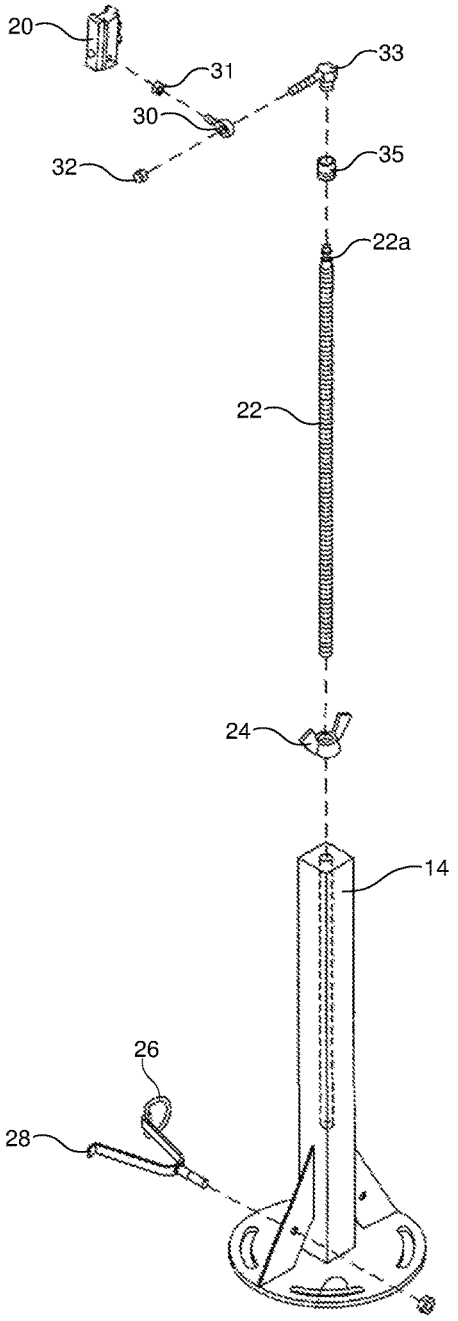
FIG. 3 is a perspective exploded view illustrating an exemplary shooting-stability platform according to the invention.

FIG. 3 is an exploded view of the exemplary shooting-stability platform 10 showing the details of the connection between the threaded riser 22 and the accessory-rail adapter 20. The upper end of the threaded riser 22 terminates in a male coupling 22*a*. The male coupling 22*a* and the threaded riser 22 may be connected in a variety of ways; for example, the male coupling 22*a* may be welded or glued to the threaded riser 22 or it may be machined into the threaded riser 22. A joint-bolt 33 is attached to a female coupling 35 at one end. The female coupling 35 is configured to selectively couple with the male coupling 22*a* to form an articulating coupling joint 22*a*/35. The joint-bolt 33 is attached to an articulating joint 30 at the other end via a locknut 32. The articulating joint 30 is attached to the accessory-rail adapter 20 via threads on the joint 30 and in the adapter 20. A locknut 31 secures the connection between the joint 30 and adapter 20. In one embodiment, the male coupling 22*a* and female coupling 35 may be the common M-style plug and coupler, respectively.

Figure 4:
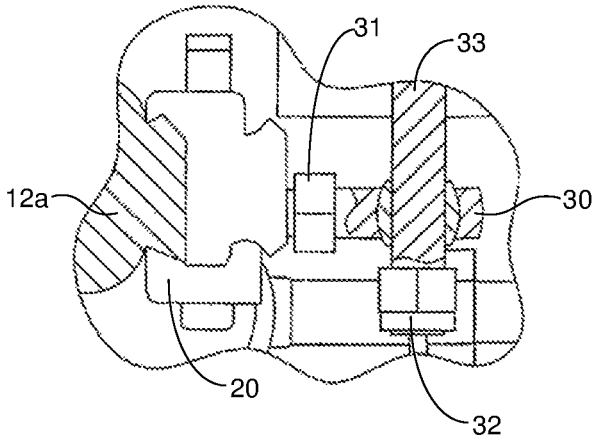
FIG. 4 is a section view of an exemplary accessory-rail adapter, articulating joint, and joint bolt of an exemplary shooting-stability platform according to the invention.

FIG. 4 is a sectional view illustrating the connections among the articulating joint 30, the bolt 33, and the accessory-rail adapter 20.

Figure 5:
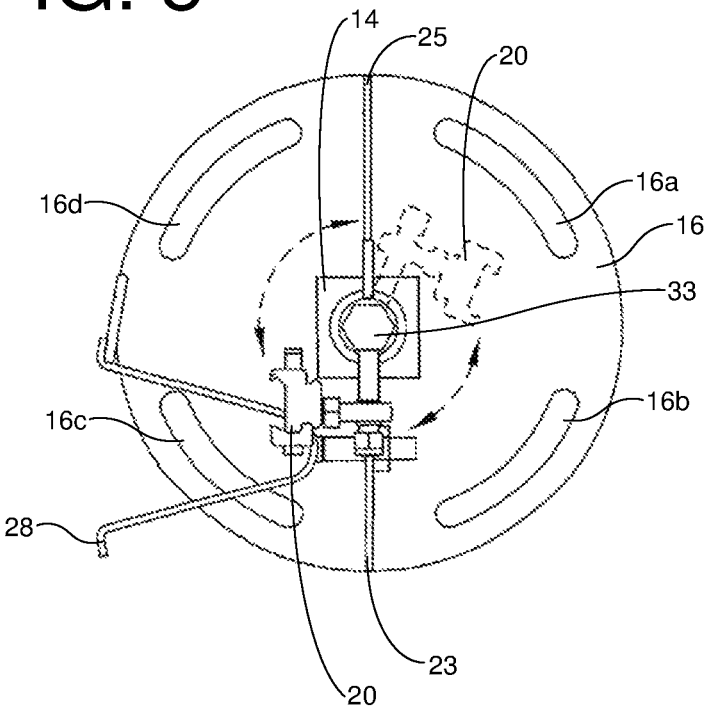
FIG. 5 is a top view illustrating an azimuthal rotational degree of freedom of the accessory-rail adapter of an exemplary shooting-stability platform according to the invention.

FIG. 5 is a top view of the exemplary shooting-stability platform 10. The base plate 16 includes four slots 16*a*, 16*b*, 16*c*, 16*d*, that are used to mount the platform 10 to, for example, an ATV. The dashed lines in the figure show how the accessory-rail adapter 20 may rotate about the threaded riser 22. The joint defined by the male coupling 22*a* and the female coupling 35 allows the female coupling 35 to rotate about the male coupling 22*b*. Because of this, the accessory-rail adapter 20 may rotate 360 degrees about the threaded riser 22. Thus, the firearm operator may attach a firearm to the shooting-stability platform 10 through the accessory-rail adapter 20 and still be able to azimuthally rotate the firearm about the threaded riser 22 to select a target, subject only to environmental constraints such as might be imposed by a vehicle to which the platform 10 is attached (e.g., the ATV).

Figure 6:
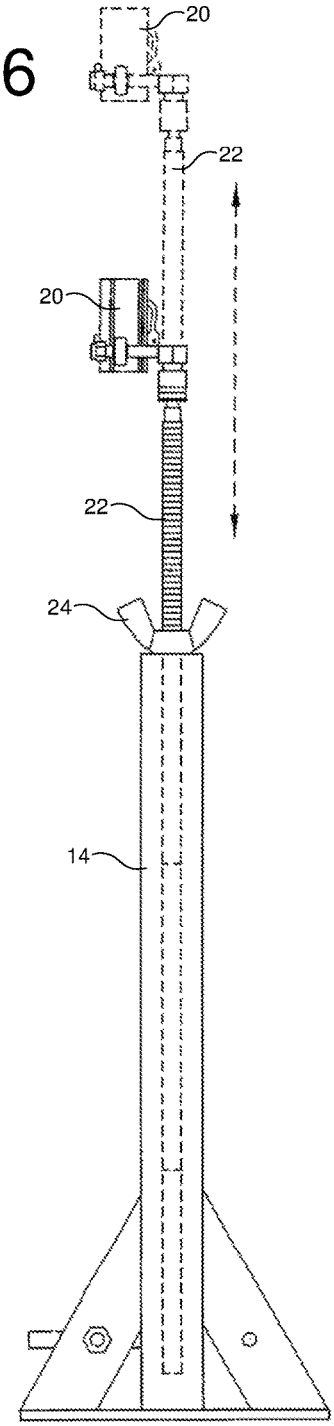
FIG. 6 is a front view illustrating an exemplary shooting-stability platform according to the invention.

FIG. 6 is a front view of the exemplary shooting-stability platform 10. This figure illustrates that the firearm operator may adjust the length of the threaded riser 22 extending from the tubing riser 14 and thereby adjust the height at which the firearm is positioned when attached to the shooting-stability platform 10 through the accessory-rail adapter 20. To increase the length, the wingnut 24 is loosened, the threaded riser 22 is threaded out of the tubing riser 14, and the wingnut 24 is tightened when the desired length is reached. The dashed lines indicate that the threaded riser 22 may be lowered or raised and the dashed elements show the accessory-rail adapter 20 at a raised position. Thus, the firearm operator can readily set the height of the firearm for optimal accuracy and safety.

Figure 7:
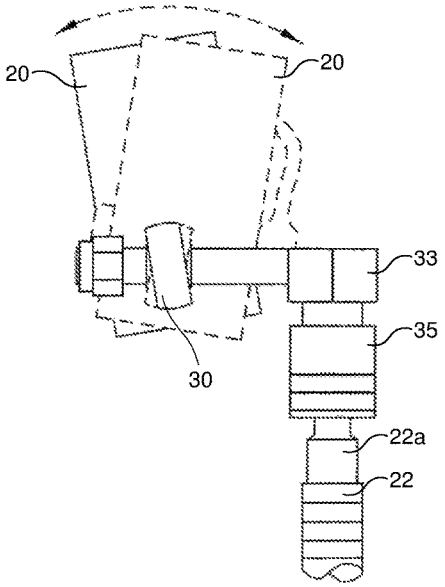
FIG. 7 is a front view illustrating a cant rotational degree of freedom of the accessory-rail adapter of an exemplary shooting-stability platform according to the invention.

FIG. 7 is a front view of the accessory-rail adapter 20 illustrating that the adapter 20—and any firearm it is holding—can twist side-to-side to change the angle of the firearm relative to the longitudinal axis of the threaded riser 22. This cant angle is the angle between the normal from the accessory-rail adapter 20 (which, in this example, corresponds to the vertical axis of a firearm mounted to the adapter 20 via an accessory rail on the bottom of the firearm) and the longitudinal axis of the threaded riser 22. The dashed lines indicate the adapter 20 may be twisted back and forth, the dashed elements show the adapter 20 and articulating joint 30 as canted to the right, the solid elements show the adapter 20 and articulating joint 30 as canted to the left. Thus, the firearm operator may adjust the cant angle of the firearm to optimize accuracy and safety. For example, if the operator wishes a zero-degree cant angle with respect to true vertical and the platform 10 is positioned such that the axis of the threaded riser 22 is off true vertical, the operator can simply twist the firearm to account for the tilt of the threaded riser 22.

Figure 8:
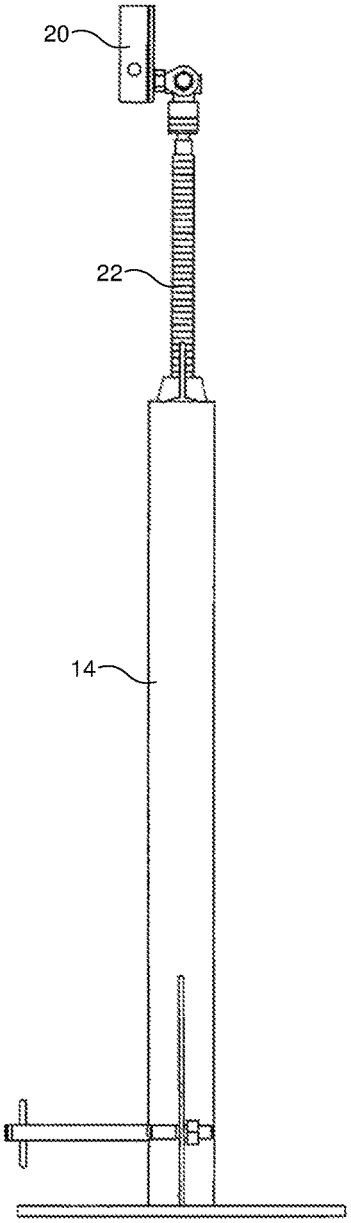
FIG. 8 is a side view illustrating an exemplary shooting-stability platform according to the invention.
Figure 9:
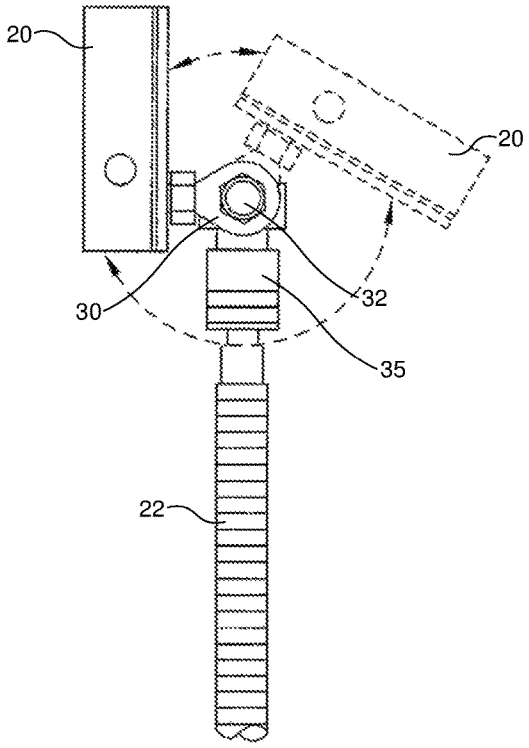
FIG. 9 is a side view illustrating a polar-angle rotational degree of freedom of the accessory-rail adapter of an exemplary shooting-stability platform according to the invention.

FIGS. 8-9 are side views illustrating that the accessory-rail adapter 20 can rotate about the longitudinal axis of the joint-bolt 33. The dashed lines indicate the adapter 20 may be rotated about the joint-bolt 33, the dashed elements show the adapter 20 in a slightly declined position relative to the longitudinal axis of the threaded riser 22, and the solid elements show the adapter 20 aligned roughly parallel to the longitudinal axis of the threaded riser 22. If the threaded riser 22 was aligned with true vertical, the dashed-element position would correspond to a firearm pointing slightly down from horizontal and the solid-element position would correspond to a firearm pointing straight up. Thus, the firearm operator may adjust the polar angle of the firearm with respect to the longitudinal access of the threaded riser 22. (The polar angle relates directly to the angle of elevation from the horizon if the threaded riser 22 is perpendicular to the horizon.)

Figure 10:
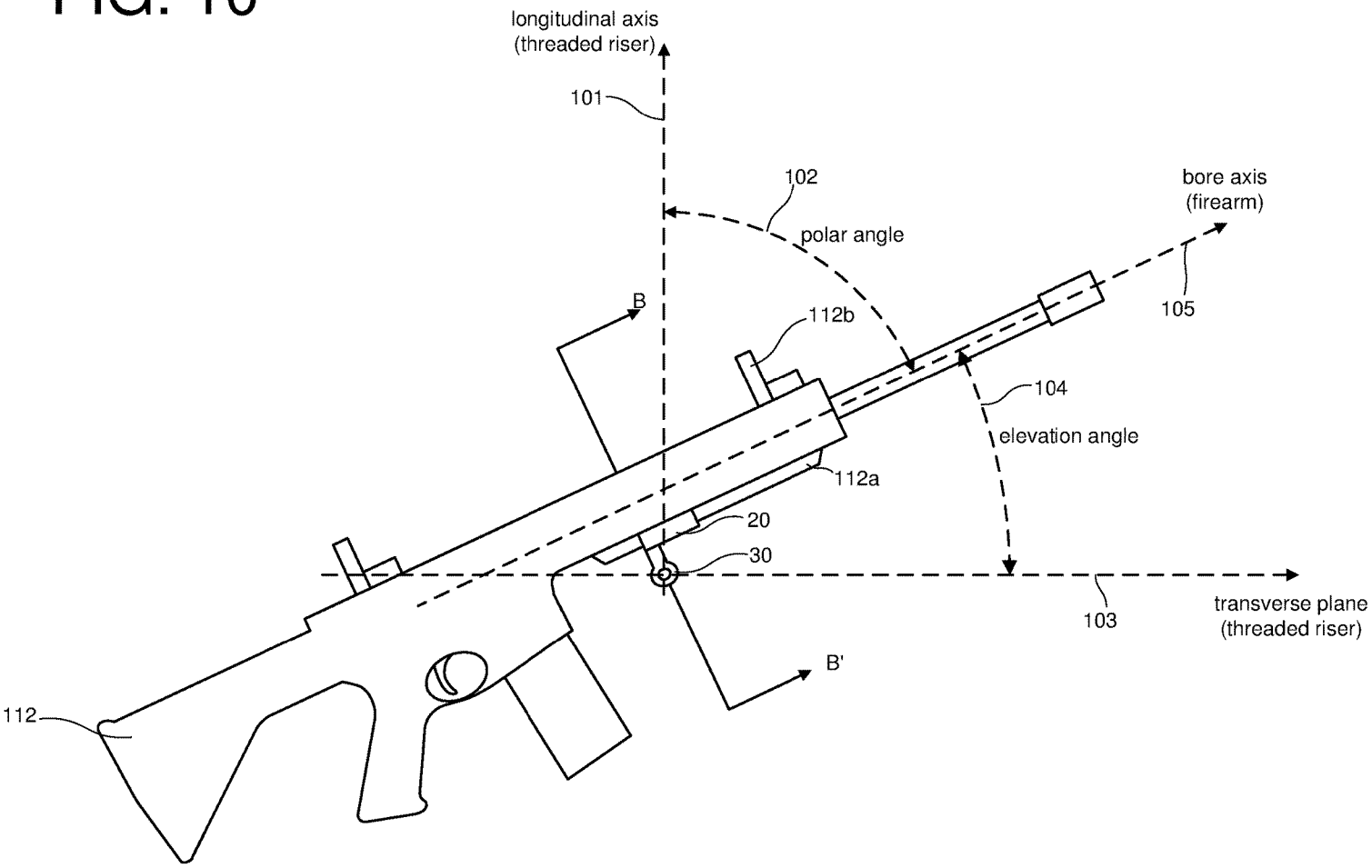
FIG. 10 is a side view illustrating a firearm's polar-angle rotational degree of freedom when mounted to an exemplary shooting-stability platform according to the invention.

FIG. 10 is a side view illustrating that a firearm 112 has a polar-angle 102 degree of freedom to rotate about the articulating joint 30 when mounted to a shooting-stability platform via the accessory-rail adapter 20 and an accessory rail 112*a* on the firearm 112. For sake of clarity, only the accessory-rail adapter 20 and articulating joint 30 of the shooting-stability platform are shown. A rotational coordinate system 101/103 is defined by the threaded riser's 22 longitudinal axis 101 and the plane 103 transverse to that longitudinal axis 101. A polar angle 102 is defined by the bore axis 105 of the firearm 112 and the longitudinal access 101 of the threaded riser 22. The firearm 112 has a substantial degree of freedom to rotate about the articulating joint 30, thus the firearm operator may alter the polar angle 102 (equivalently, the operator may alter the elevation angle 104 with respect to the transverse plane 103). For the exemplary articulating joint 30 (a Heim joint), the joint 30 allows 360 degrees of polar-angle rotation. Alternatively, articulating joints with a lesser degree of freedom with respect to polar-angle rotation may be used. For example, the articulating joint may be a ball joint that allows ±90 degrees (180 degrees) or ±45 degrees (90 degrees) of polar-angle rotation. The articulating joint and mounting configuration may be chosen to tune the polar-angle degree of freedom as desired.

Figure 11:
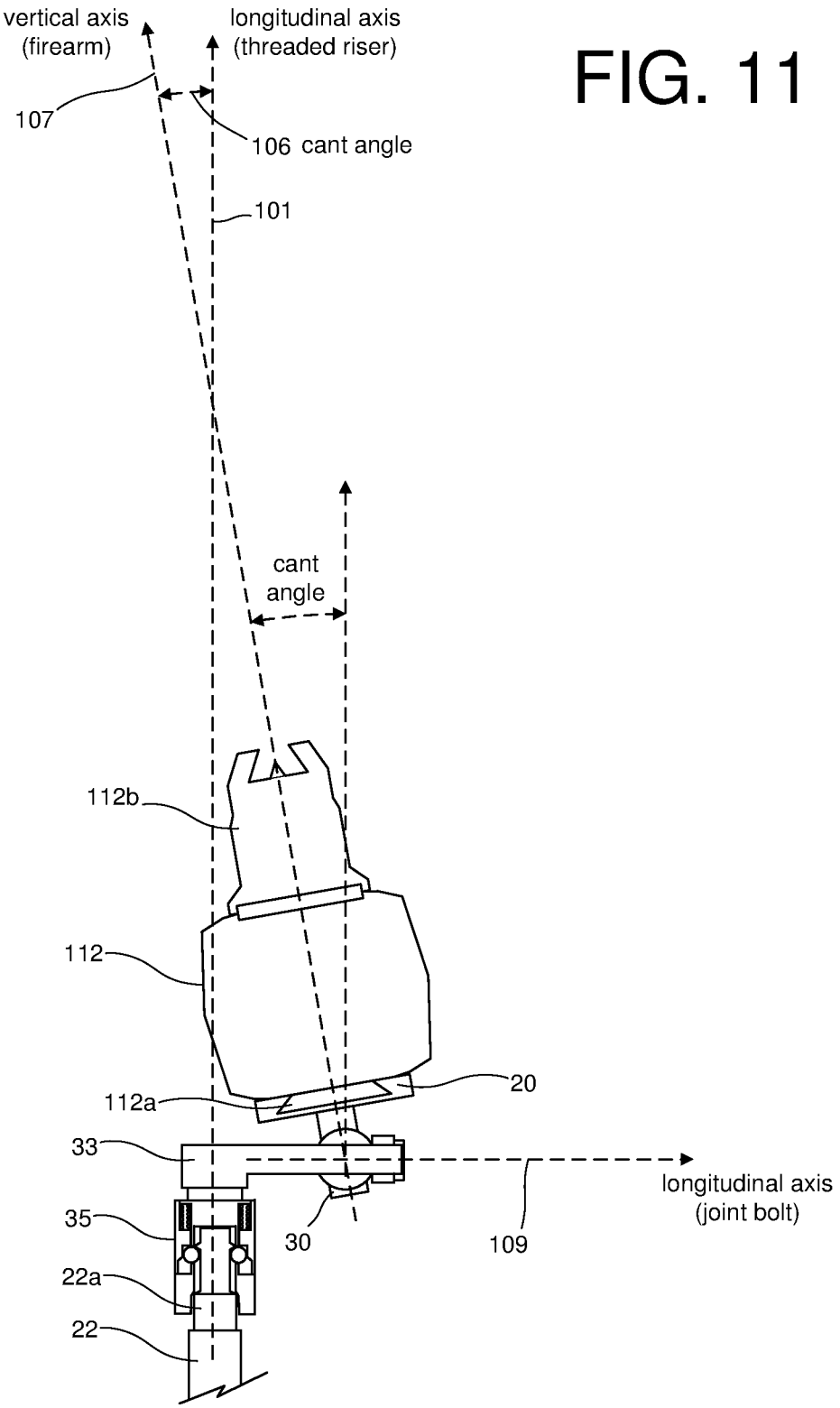
FIG. 11 is a rear section view illustrating a firearm's cant-angle rotational degree of freedom when mounted to an exemplary shooting-stability platform according to the invention.

FIG. 11 is a rear view of section B-B' from FIG. 10. FIG. 11 illustrates that the firearm 112 has a cant-angle 106 degree of freedom to rotate about the articulating joint 30 when mounted to the shooting-stability platform via the accessory-rail adapter 20 and accessory rail 112*a*. A cant angle 106 is defined by the born vertical axis 107 of the firearm 112 and the longitudinal access 101 of the threaded riser 22. The firearm 112 has substantial degree of freedom to rotate about the articulating joint 30, thus the firearm operator may alter the cant angle 106. For the exemplary articulating joint 30 (a Heim joint) as connected to the joint bolt 33, the joint 30 allows about ±15 degrees (30 degrees) of cant-angle rotation. Alternatively, a different assembly or different articulating joint may be used to allow for a greater or lesser degree of freedom with respect to cant-angle rotation. For example, the articulating joint may be a ball joint that allows ±45 degrees (90 degrees) of polar-angle rotation or a ball joint that allows ±5 degrees (10 degrees). The joint and mounting configuration may be chosen to tune the cant-angle degree of freedom as desired. The exemplary joint bolt 33 is depicted with a longitudinal axis 109 that is substantially perpendicular to the threaded riser's 22 longitudinal axis 101. The invention, however, is not restricted to the perpendicular configuration—the joint bolt may be configured at other angles with respect to the threaded riser.

Figure 12:
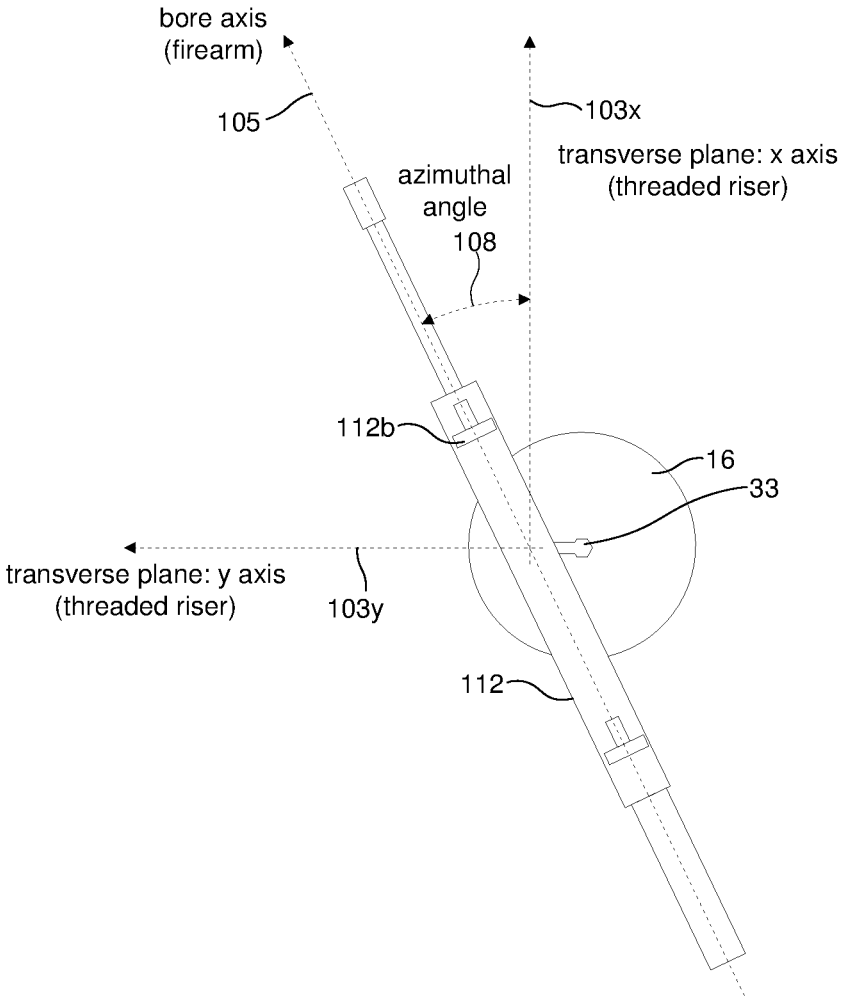
FIG. 12 is a top view illustrating a firearm's azimuthal-angle rotational degree of freedom when mounted to an exemplary shooting-stability platform according to the invention.

FIG. 12 is a top view illustrating that the firearm 112 has an azimuthal-angle 108 degree of freedom to rotate about the coupling joint (the hinge joint defined by the female coupling 35 and the male coupling 22*a*) when mounted to a shooting-stability platform via the accessory-rail adapter 20 and accessory rail 112*a*. A rotational coordinate system 103*x*/103*y* is defined by the plane 103 transverse to the longitudinal axis 101 of the threaded riser. The azimuthal angle 108 is defined by the bore axis 105 of the firearm 112 and the "x" axis 103*x* of the coupling joint 22*a*/35. The firearm 112 has substantial degree of freedom to rotate about the coupling joint 22*a*/35, thus the firearm operator may alter the azimuthal angle 108. For the exemplary coupling joint 22*a*/35 (a M-style coupler and plug), the joint 22*a*/35 allows 360 degrees of azimuthal-angle rotation. Alternatively, a hinge joint or ball joint with a lesser degree of freedom with respect to azimuthal-angle rotation may be used. For example, the coupling joint may be a hinge joint that allows ±90 degrees (180 degrees) or ±45 degrees (90 degrees) of azimuthal-angle rotation. The coupling joint and mounting configuration may be chosen to tune the azimuthal-angle degree of freedom as desired.

Figure 13:
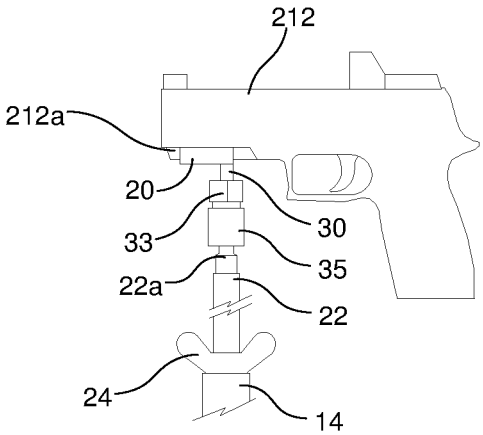
FIG. 13 illustrates a pistol mounted to an exemplary shooting-stability platform according to the invention.
Figure 14:
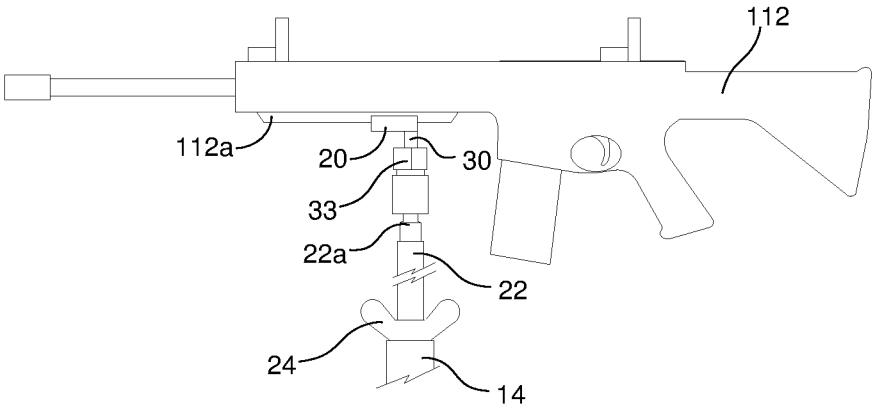
FIG. 14 illustrates a rifle mounted to an exemplary shooting-stability platform according to the invention.

FIGS. 13-14 illustrate firearms mounted to a shooting-stability platform. A handgun 212 is shown in FIG. 13. A rifle 112 is shown in FIG. 14. During discharge, the shooting-stability platform lessens the effect of recoil in that the platform restricts certain translational and rotational movement of the firearm during discharge. For example, because the platform constrains the firearm from moving up or down at the point the accessory-rail adapter 20 is attached to the accessory rail 212*a* (or 112*a*), it is easier for the operator holding the grip of the firearm to prevent muzzle rise than if the firearm was free of the platform. Similarly, because the platform absorbs some of the recoil, it is easier for the operator to prevent the firearm from moving in response to the recoil.

Figure 15:
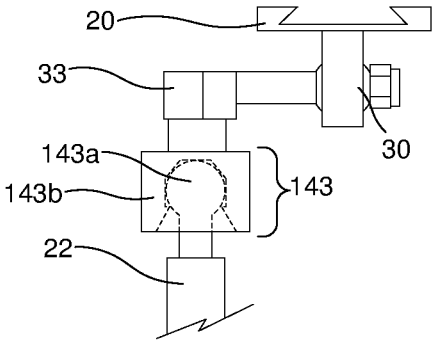
FIGS. 15-17 illustrate exemplary embodiments of the articulating joints of exemplary shooting-stability platforms according to the invention.
Figure 16:
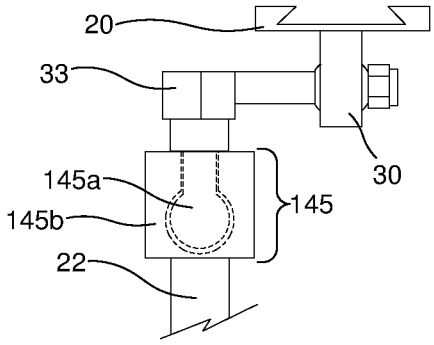
Figure 17:
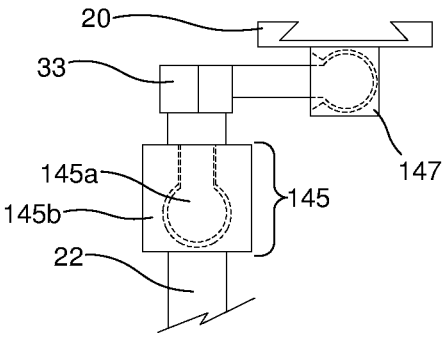
Figure 18:
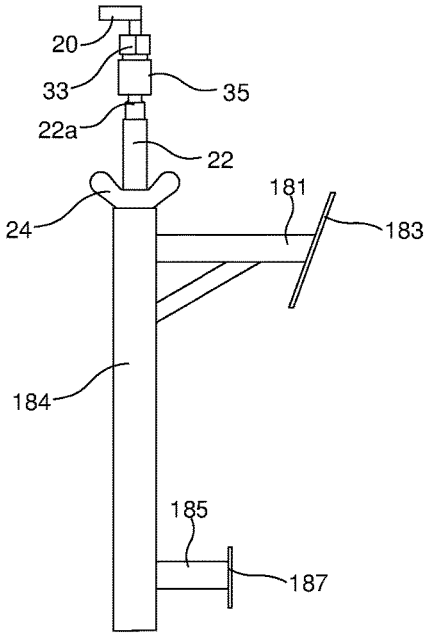
FIGS. 18-21 illustrate exemplary embodiments of mounting configurations of exemplary shooting-stability platforms according to the invention.
Figure 19:
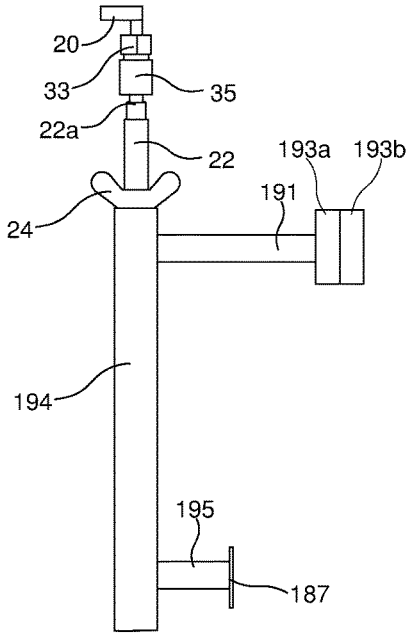

FIGS. 15-17 illustrate further exemplary embodiments of the articulating joints. In FIG. 15, the coupling joint 22*a*/35 depicted in FIG. 11 is replaced by a ball joint 143 comprising a ball 143*a* and a socket 143*b*. In this embodiment, the socket is attached to the joint bolt 33 and the ball is attached to the threaded riser 22. The dashed lines indicate the interior of the joint, which is not visible when the joint is intact. The ball joint 143 has three degrees of freedom: a polar-angle degree of freedom, a cant-angle degree of freedom, and an azimuthal-angle degree of freedom. In FIG. 16, the coupling joint 22*a*/35 depicted in FIG. 11 is replaced by a ball joint 145 comprising a ball 145*a* and a socket 145*b*. In this embodiment, the socket is attached to the threaded riser 22 and the ball is attached to the bolt joint 33. The dashed lines indicate the interior of the joint, which is not visible when the joint is intact. The ball joint 145 has one degree of freedom: an azimuthal-angle degree of freedom. In FIG. 17, the Heim joint 30 depicted in FIG. 16 is replaced by a ball joint 147 similar in structure to the ball joint 143 of FIG. 15. In the FIG. 17 embodiment, the socket is attached to the accessory-rail adapter 20 and the ball is attached to the bolt joint 33. The ball joint 147 has three degrees of freedom: a polar-angle degree of freedom, a cant-angle degree of freedom, and an azimuthal-angle degree of freedom. Various other joint configurations will be apparent to one of ordinary skill in the art.

Figure 20:
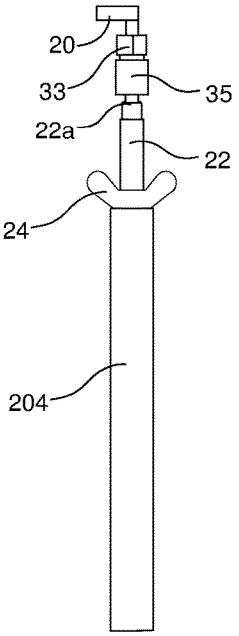
Figure 21:
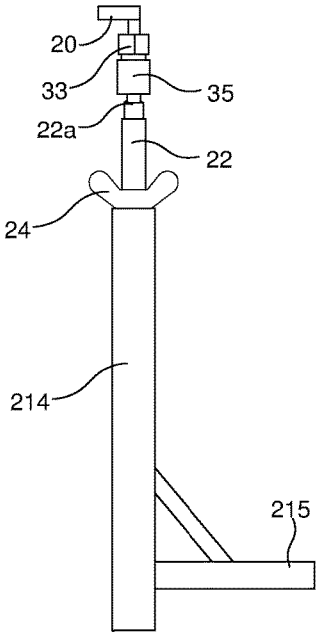

FIGS. 18-21 illustrate further exemplary embodiments of mounting configurations for a shooting-stability platform. The shooting-stability platform depicted in FIG. 18 includes two mounting bars 181, 185 each terminating in a mounting plate 183, 187. The mounting bars 181, 185 and mounting plates 183, 187 are configured to bolt to the cab of a vehicle, such as a utility transport vehicle (UTV). The shooting-stability platform depicted in FIG. 19 includes two mounting bars 191, 195. The top mounting bar 191 terminates in a clamp comprising two pieces 193*a*, 193*b*. The lowest mounting bar 195 terminates in a mounting plate 197 similar to the lower mounting plate 185 in the FIG. 18 embodiment. The clamp's two pieces 193*a*, 193*b* are configured to fit about and clamp to a feature of a vehicle such as a roll bar on a UTV. The shooting-stability platform depicted in FIG. 20 is configured to fit into a hole of a vehicle, such as a stake pocket of a pickup truck. The shooting-stability platform depicted in FIG. 21 includes a mounting bar 215 that is configured to fit in a trailer-hitch receiver mounted on a vehicle. Various other mounting configurations will be apparent to one of ordinary skill in the art.

While the foregoing description is directed to the preferred embodiments of the invention, other and further embodiments of the invention will be apparent to those skilled in the art and may be made without departing from the basic scope of the invention. And features described with reference to one embodiment may be combined with other embodiments, even if not explicitly stated above, without departing from the scope of the invention. The scope of the invention is defined by the claims which follow.

The invention claimed is:

1. An apparatus for stabilizing a firearm during discharge, the apparatus comprising:

(a) a first riser;

(b) a second riser having a first end and a second end, wherein the first end of the second riser connects to the first riser;

(c) a first articulating joint;

(d) a second articulating joint; and (e) an accessory-rail adapter;

(f) wherein the accessory rail adapter is connected to the second articulating joint which is connected to the first articulating joint which is connected to the second end of the second riser;

(g) wherein the first articulating joint allows rotational movement of the accessory-rail adapter in an azimuthal direction around the longitudinal axis of the second riser;

(h) wherein the second articulating joint allows rotational movement of the accessory-rail adapter in a polar direction with respect to the longitudinal axis of the second riser; and (i) wherein the first articulating joint or the second articulating joint allows for rotational movement of the accessory-rail adapter in a cant direction with respect to the longitudinal axis of the second riser.

2. The apparatus of claim 1 wherein the first riser has an internal thread, the second riser has an external thread configured to engage the first riser's internal thread, and the first end of the second riser connects to the first riser by engagement of the first riser's internal thread with the second riser's external thread.

3. The apparatus of claim 2 wherein the second riser may be selectively positioned relative to the first riser by threading the second riser into or out of the first riser.

4. The apparatus of claim 1 wherein the first riser is a tube configured to telescopically engage with the second riser and the first end of the second riser connects to the first riser by telescopically engaging the first riser.

5. The apparatus of claim 4 wherein the second riser may be selectively positioned relative to the first riser by telescopically sliding the first riser and second riser together or apart.

6. The apparatus of claim 1 wherein the first articulating joint is one of the group consisting of a rod-end bearing, a ball joint, and a hinge joint.

7. The apparatus of claim 1 wherein the second articulating joint is one of the group consisting of a rod-end bearing, a ball joint, and a hinge joint.

8. The apparatus of claim 1 wherein the first articulating joint allows 360 degrees of rotational movement of the accessory-rail adapter in an azimuthal direction around the longitudinal axis of the second riser.

9. The apparatus of claim 1 wherein the first articulating joint allows at least 180 degrees of rotational movement of the accessory-rail adapter in an azimuthal direction around the longitudinal axis of the second riser.

10. The apparatus of claim 1 wherein the first articulating joint allows at least 10 degrees of rotational movement of the accessory-rail adapter in an azimuthal direction around the longitudinal axis of the second riser.

11. The apparatus of claim 1 wherein the second articulating joint allows 360 degrees of rotational movement of the accessory-rail adapter in a polar direction with respect to the longitudinal axis of the second riser.

12. The apparatus of claim 1 wherein the second articulating joint allows at least 180 degrees of rotational movement of the accessory-rail adapter in a polar direction with respect to the longitudinal axis of the second riser.

13. The apparatus of claim 1 wherein the second articulating joint allows at least 10 degrees of rotational movement of the accessory-rail adapter in a polar direction with respect to the longitudinal axis of the second riser.

14. The apparatus of claim 1 wherein the first articulating joint or the second articulating joint allows for at least 30 degrees of rotational movement of the accessory-rail adapter in a cant direction with respect to the longitudinal axis of the second riser.

15. The apparatus of claim 1 wherein the first articulating joint or the second articulating joint allows for at least 5 degrees of rotational movement of the accessory-rail adapter in a cant direction with respect to the longitudinal axis of the second riser.

16. The apparatus of claim 1 wherein the first articulating joint comprises:

(a) a male coupling; and (b) a female coupling.

17. An apparatus for stabilizing a firearm during discharge, the apparatus comprising:

(a) a riser;

(b) a first articulating joint;

(c) a second articulating joint; and (d) an accessory-rail adapter;

(e) wherein the accessory rail adapter is connected to the second articulating joint which is connected to the first articulating joint which is connected to the riser;

(f) wherein the first articulating joint allows rotational movement of the accessory-rail adapter in an azimuthal direction or polar direction or cant direction with respect to the longitudinal axis of the riser;

(g) wherein the second articulating joint allows rotational movement of the accessory-rail adapter in an azimuthal direction or polar direction or cant direction with respect to the longitudinal axis of the riser; and (h) wherein the first articulating joint and the second articulating joint cooperate to provide a firearm, when mounted to the accessory-rail adapter, an azimuthal-angle degree of freedom, a polar-angle degree of freedom, and a cant-angle degree of freedom.

18. The apparatus of claim 17 wherein the riser has an adjustable length.

19. An apparatus for stabilizing a firearm during discharge, the apparatus comprising:

(a) a riser having an adjustable length;

(b) a means for attaching the firearm, when installed;

(c) a means for allowing the firearm operator to alter the azimuthal angle of the firearm, when attached, wherein the azimuthal angle is with respect to the longitudinal axis of the riser;

(d) a means for allowing the firearm operator to alter the polar angle of the firearm, when attached, wherein the polar angle is with respect to the longitudinal axis of the riser; and (e) a means for allowing the firearm operator to alter the cant angle of the firearm, when attached, wherein the cant angle is with respect to the longitudinal axis of the riser.

* * * * *